US007520497B2

(12) United States Patent
Moriyama et al.

(10) Patent No.: US 7,520,497 B2
(45) Date of Patent: Apr. 21, 2009

(54) SHEET PROCESSING APPARATUS AND IMAGE FORMING APPARATUS HAVING SAME

(75) Inventors: Tsuyoshi Moriyama, Toride (JP); Takako Hanada, Yokohama (JP); Masayoshi Taira, Kashiwa (JP); Akinobu Nishikata, Kashiwa (JP); Hiroaki Tomiyasu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 659 days.

(21) Appl. No.: 11/082,808

(22) Filed: Mar. 18, 2005

(65) Prior Publication Data

US 2005/0212194 A1 Sep. 29, 2005

(30) Foreign Application Priority Data

Mar. 23, 2004 (JP) ..... 2004-085377
Mar. 9, 2005 (JP) ..... 2005-065415

(51) Int. Cl.
*B65H 7/02* (2006.01)

(52) U.S. Cl. ..... 270/58.07; 270/58.02; 270/58.08; 270/58.12; 270/58.17; 271/227; 271/228; 399/395

(58) Field of Classification Search ..... 270/58.02, 270/58.07, 58.08, 58.12, 58.17; 271/227, 271/228; 399/395
See application file for complete search history.

(56) References Cited

U.S. PATENT DOCUMENTS 5,122,180 A 6/1992 Mathivat et al. ..... 65/162
5,911,414 A 6/1999 Kato et al. ..... 270/58.07
6,092,393 A 7/2000 Mathivat et al. ..... 65/106
6,219,503 B1 4/2001 Miyake et al. ..... 399/85
6,264,194 B1 * 7/2001 Hayashi et al. ..... 271/220
6,273,418 B1 * 8/2001 Fujikura et al. ..... 271/228
6,330,422 B1 12/2001 Sato et al. ..... 399/382
6,337,970 B1 1/2002 Okamoto et al. ..... 399/407
6,371,472 B1 4/2002 Miyake et al. ..... 270/58.14
6,386,080 B1 * 5/2002 Okamoto et al. ..... 83/73
6,421,523 B1 7/2002 Kondo et al. ..... 399/404

(Continued)

FOREIGN PATENT DOCUMENTS

JP 3-190696 8/1991

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

The invention comprises registration roller pairs which detect a skew amount of a sheet being conveyed; registration roller pairs which perform skew correction of the sheet while the sheet is being conveyed; a punch unit which performs punching of the sheet; a punch-unit driving portion which drives the punch unit; a sheet-edge detecting sensor which performs detection of a sheet edge in a direction intersecting with a sheet conveyance direction; a punch-unit moving device which moves the punch unit in the direction intersecting with the sheet conveyance direction; a sheet detecting sensor which performs detection of a sheet position in the sheet conveyance direction; and a controller portion which performs control such that after skew of the sheet is corrected by the registration roller pairs in accordance with detection results of skew amount sensors, and punching is performed on the sheet by the punch-unit moving device and the punch driving portion in accordance with a detection result of the sheet detecting sensor.

17 Claims, 10 Drawing Sheets

U.S. PATENT DOCUMENTS

| | | | | |
|---|---|---|---|---|
| 6,473,590 | B2 | 10/2002 | Matsumoto et al. | 399/404 |
| 6,505,017 | B2 | 1/2003 | Fuimii et al. | 399/82 |
| 6,578,844 | B2 * | 6/2003 | Acquaviva et al. | 271/228 |
| 6,603,951 | B2 | 8/2003 | Sato et al. | 399/382 |
| 6,636,720 | B2 | 10/2003 | Fujii et al. | 399/382 |
| 6,751,426 | B2 | 6/2004 | Akiba et al. | 399/382 |
| 6,783,124 | B2 * | 8/2004 | Tamura et al. | 270/58.07 |
| 6,813,472 | B2 * | 11/2004 | Aizawa | 399/388 |
| 6,871,042 | B2 | 3/2005 | Nemura et al. | 399/389 |
| 6,904,261 | B2 | 6/2005 | Fujii et al. | 399/382 |
| 7,003,257 | B2 * | 2/2006 | Yoshie et al. | 399/389 |
| 2002/0079640 | A1 * | 6/2002 | Yoshie et al. | 271/176 |
| 2003/0080487 | A1 * | 5/2003 | Tamura et al. | 270/58.07 |
| 2003/0118384 | A1 | 6/2003 | Moriyama | 399/382 |
| 2003/0146566 | A1 * | 8/2003 | Aizawa | 271/242 |

FOREIGN PATENT DOCUMENTS

| | | |
|---|---|---|
| JP | 6-135620 | 5/1994 |
| JP | 10-194557 | 7/1998 |
| JP | 11-92020 | 4/1999 |

* cited by examiner

SHEET PROCESSING APPARATUS AND IMAGE FORMING APPARATUS HAVING SAME

BACKGROUND OF THE INVENTION

1. Field of the Invention

The present invention relates to a sheet processing apparatus for performing sorting, binding, stacking, and the like operations for sheets being discharged from an image forming apparatus or the like. More specifically, the invention relates to a sheet processing apparatus having a punch unit for punching a hole(s) into a sheet(s).

2. Description of the Related Art

Conventionally known sheet processing apparatuses includes a type that provides a post-process including, for example, sorting, binding, stacking, and hole punching to post-image-forming sheets being discharged from an image forming apparatus.

In addition, known punching method for punching a punch hole(s) into a sheet(s) in a sheet processing apparatus of the type described above include, for example, a method that stops a sheet being discharged at a constant interval from an image forming apparatus and performs punch processing of the sheet one by one.

Further, there is a known method wherein a punch unit provided and constituted of punches and dies arranged on a sheet conveying path is provided, wherein a sheet conveyance speed and a punch processing speed are synchronized to each other thereby to perform punch processing without stopping the sheet being convey, whereby the operation is performed without causing sheet processing time to be increased depending on presence or absence of the operation of the punch processing.

According to the conventional techniques, a lead edge or trail edge of the sheet being conveyed is detected, and the timing of hole punching is changed in accordance with the detecting result to thereby adjust the punching position in the sheet conveyance direction.

There is an other known method for adjusting the punching position, wherein an edge of a sheet being conveyed is detected, and a punch unit is moved to thereby move the sheet, which is being conveyed, in the sheet-width direction. Thereby, the punching position is adjusted in the direction (sheet-width direction) intersecting with the sheet conveyance direction vehicle-body width direction.

As documents disclosing related conventional examples, there are, Japanese Patent Application Laid-Open No. 03-190696, No. 06-135620, and No. 10-194557.

However, problems occur with the sheet processing apparatus wherein the sheet conveyance speed and the punch processing speed are synchronized to each other, and the punch processing is performed on a plurality of portions along a line parallel or perpendicular to the sheet conveyance direction without stopping the sheet being conveyed. The problems are that when a sheet is fed into the punch unit in the state of the paper being skewed (state of the paper being skewed with respect to the conveyance direction), the punch processing is performed on the sheet in the state of the paper being kept skewed, whereby a plurality of punch holes are punched in the sheet along a skewed line on the sheet. The tendency of such skew especially increases in a case where a conveyance path from the image forming apparatus to the punch unit is long.

Several methods have been proposed as methods of correcting such skew as described above. For example, a register-loop correcting method has been proposed. According to this method, the lead edge of a sheet is abutted against a nip of a stopping roller pair thereby to form a deflection of the sheet, and the lead edge of the sheet is then placed along the nip of the roller pair by utilizing elasticity of the sheet, thereby collecting skew.

As another method, there is a shutter skew correcting method wherein a shutter member for stopping a sheet lead edge is provided so as to be pulled back in a sheet conveyance path, and the shutter member is pulled back from the sheet conveyance path after the sheet lead edge is abutted against the shutter member, thereby to correct the skew.

In recent years, with increased speeds of image forming apparatuses, it is demanded that a sheet-to-sheet interval (inter-sheet interval) is even more reduced thereby to enhance the throughput (work volume to be processed within a fixed time).

However, in the case that the above-described correcting method is adapted for use with the conventional sheet processing apparatus that performs the punch processing, a sheet being conveyed needs to be once stopped, so that the time required for the punch processing is significantly increased. Especially, compared to the case where the punch processing is not performed, productivity is significantly diminished in the case where the inter-sheet interval is short.

SUMMARY OF THE INVENTION

The invention is made in view of the problems described above. Accordingly, it is an object of the invention to provide a sheet processing apparatus that improves punched position accuracy without diminishing productivity even when skew correction is performed at the time of punch processing.

The invention is a sheet processing apparatus constructed as described below in order to solve the technical problems described above.

More specifically, a sheet processing apparatus of the invention is characterized by comprising a skew amount detecting portion which detects a skew amount of a sheet being conveyed; a skew correcting portion which performs skew correction of the sheet while the sheet is being conveyed; a punch unit which performs punching of the sheet; a punch driving portion which drives the punch unit; a sheet-edge detecting sensor which performs detection of a sheet edge in a direction intersecting with a sheet conveyance direction; a punch-unit moving device which moves the punch unit in the direction intersecting with the sheet conveyance direction; a sheet detecting sensor which performs detection of a sheet position in the sheet conveyance direction; and a controller portion which performs control of the skew correction of the sheet and a punching operation on the sheet. The controller portion performs the control such that after skew of the sheet is corrected by the skew correcting portion in accordance with a detection result of the skew amount detecting portion, positioning of the punch unit in the direction intersecting with the sheet conveyance direction is performed by the punch-unit moving device in accordance with a detection result of the sheet-edge detecting sensor, and punching is performed on the sheet by the punch driving portion in accordance with a detection result of the sheet detecting sensor.

DETAILED DESCRIPTION OF THE PREFERRED EMBODIMENTS

First Embodiment

As a best mode for carrying out the invention, a first embodiment will be described in detail herebelow by using FIGS. 1 to 8.

(Description of Image Forming Apparatus)

Figure 1:
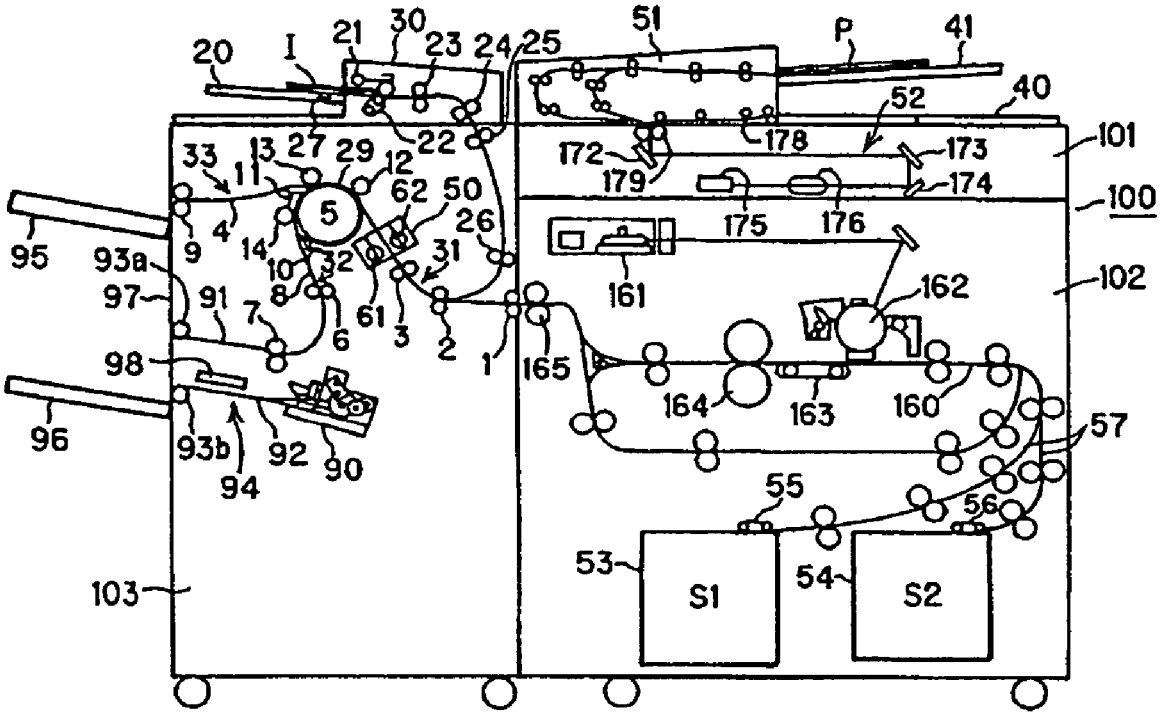
FIG. 1 is a longitudinal, sectional front elevation view of a sheet processing apparatus and a mainbody of an image forming apparatus having the sheet processing apparatus, according to the invention.
Figure 2:
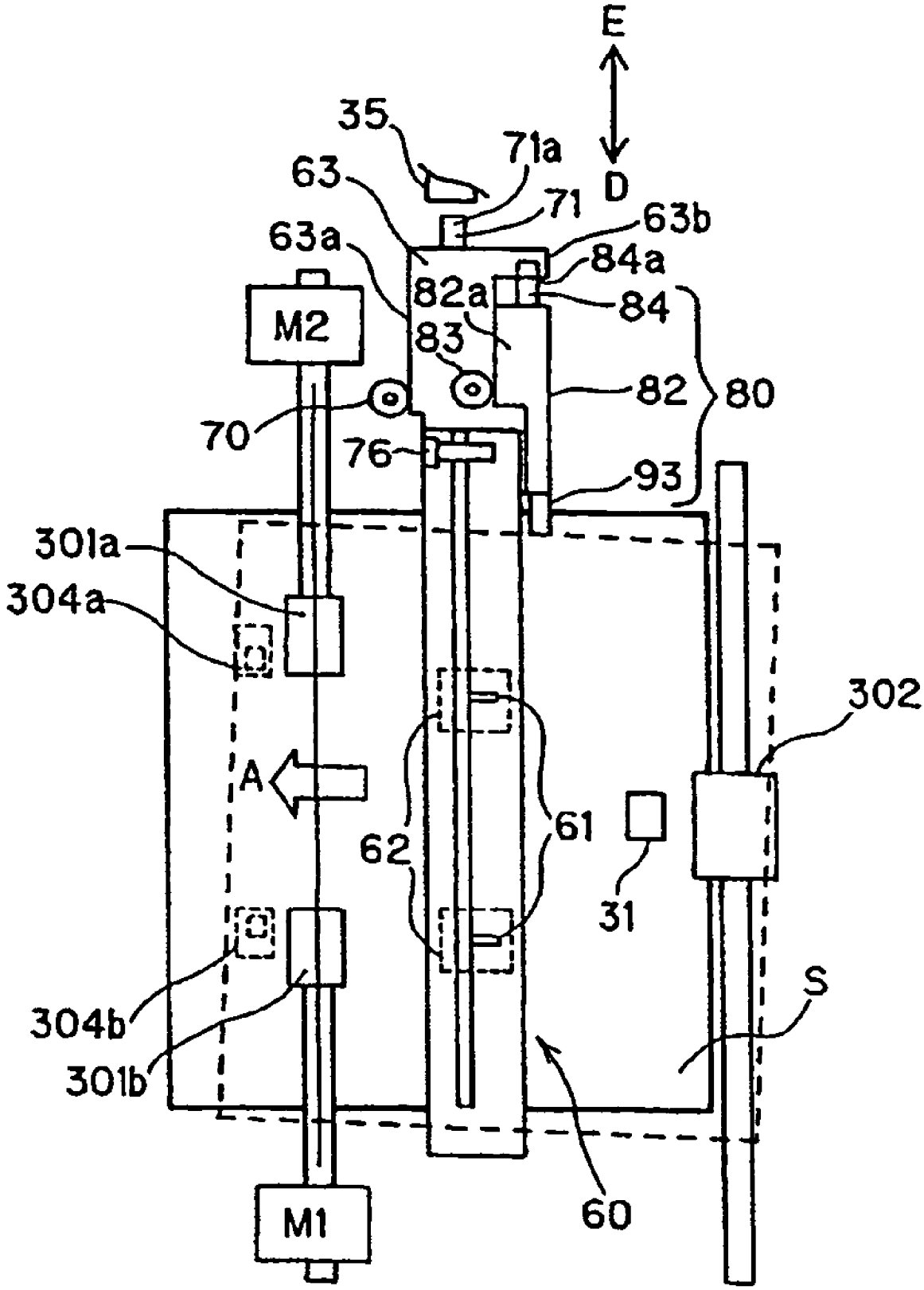
FIG. 2 is a plan view showing a punch unit and a skew correcting portion according to a first embodiment of the invention.

First, an image forming apparatus will be described. FIG. 1 is a longitudinal, sectional front elevation view showing the entirety of an image forming apparatus 100 constructed of a read-sheet feeding portion 101, an image forming apparatus mainbody 102, and a sheet processing apparatus 103 (also called "finisher"). FIG. 2 is a plan view of a punching device 50 provided in the sheet processing apparatus 103.

The read-sheet feeding portion 101 is constructed of an automatic original feeding portion 51 and an optical system 52. The optical system 52 feeds an original P set on an original tray 41 to a document read position and then conveys to a discharge position. The optical system 52 is constructed of a lamp 179 for illuminating the original P conveyed to the read position and placed over an original base platen glass 178; reflecting mirrors 172, 173, and 174 for leading light from the original P to a line sensor 175 ("CCD," hereafter); and a lens 176 for forming an image of the original P on the CCD 175.

The image forming apparatus mainbody 102 has a plurality of sheet storage portions 53 and 54, in which different-sized recording sheets S are stacked, and sheet feeding portions 55 and 56 for feeding recording sheets S. A recording sheet S having been fed is conveyed to a sheet conveyance path 160 through a sheet conveyance path 57.

A laser scanner 161 scans a laser beam in accordance with image information read by the optical system 52, and forms a latent image on a photosensitive member of an image forming portion 162. In addition, the image forming portion 162 forms a toner image on the photosensitive member and transfers the toner image on the recording sheet S.

The recording sheet S on which the image has been formed by the image forming portion 162 is conveyed to a sheet conveyance path of the sheet processing apparatus 103 through a conveyor belt 163, a fixing roller 164 that causes the toner image on the sheet S to be fused and softened and then to be fixed, and a mainbody conveyance roller 165 (pair) (mainbody discharge member). Further, there is an operating portion 40 that is used to verify operation settings and setting contents on, for example, the image forming apparatus mainbody 102 and the sheet processing apparatus 103.

The operating portion 40 has a display portion (not shown) verifying setting contents and other members (not shown) disposed to overlap the display portion. For example, the members include touch panel keys for carrying out detail setting of image-forming operation, operation setting of the sheet processing apparatus 103, and the like; ten keys for setting numeric values such as the number of image-forming sheets; a stop key for stopping the image-forming operation; a reset key for returning settings to initial settings, and a start key for starting the image-forming operation.

An entrance roller 1 (pair) located at an entrance of the sheet processing apparatus 103, and conveys a sheet S discharged from the image forming apparatus mainbody 102. Conveyance rollers 2 and 3 (each in pair) convey the sheet S or an insertion sheet I conveyed from an inserter device 30. As one example of sheet detecting means, numeral 31 denotes a sheet detecting sensor that serves on the entrance side for detecting the passage of the sheet S or insertion sheet I being conveyed.

The punching device 50 performs hole punching in the vicinity of the trail edge of the sheet S or insertion sheet I being conveyed.

A roller 5 ("buffer roller," hereafter) has a relatively large diameter and is disposed at a portion of the course of conveyance. Press rollers 12, 13, and 14 individually disposed around an outer periphery of the buffer roller 5 presses the sheet S onto the circumferential surface of the buffer roller 5.

A first switch flapper 11 selectively switches between a non-sorting path 4 and a sorting path 8. A second switch flapper 10 switches between the sorting path 8 and a buffer path provided to temporarily preserve the sheet S or insertion sheet I.

A sheet detecting sensor 33 detects the sheet S located in the non-sorting path 4. A sheet detecting sensor 32 detects the sheet S located in the buffer path 29.

A conveyance roller 6 (pair) is provided in a path portion of the sorting path 8. A processing tray unit 94 is used to temporarily accumulate sheets S, and accumulated sheets S or insertion sheets I are collated. The processing tray unit 94 includes an intermediate tray 92 ("processing tray," hereafter) for performing stapling processing through a stapler unit 90, and a collating plate 98 for collating sheets S or insertion sheets I stacked on the processing tray 92.

One side discharge roller, namely a fixed-side discharge roller 93*b* in the present case, constituting sheet-set discharge rollers is disposed on the discharge end side of the processing tray 92.

A first discharge roller 7 (pair) is disposed in the sorting path 8, and discharges sheets S or insertion sheets I onto a processing tray 94 (first stacking tray). In addition, a second discharge roller 9 (pair) is disposed in the non-sorting path 4, and discharges the sheets S or the insertion sheets I on a sample tray 95.

An upper discharge roller 93*a* is supported by an oscillatory guide 91. When the oscillatory guide 91 has arrived at a shutting position, the upper discharge roller 93*a* is pressed into abutment with the lower discharge roller 93*b*, whereby sheets S or insertion sheets I on a processing tray 92 are discharged in units of a sheet set onto a stacking tray 96 (second stacking tray).

A sheet-set stacking guide 97 supports in abutment trail edges (trail edges with respect to the sheet-set discharge direction) of a set of sheets stacking on a stacking tray 96 and a sample tray 95. In addition, the sheet-set stacking guide 97 is concurrently used as an exterior housing of the sheet processing apparatus 103.

In the inserter device 30, an insertion sheet storage portion 20 sets insertion sheets I that will be inserted. A feeding roller 21 feeds the insertion sheets I. In addition, a separating roller 22 separates the insertion sheets I from one another.

An insertion sheet detecting sensor 27 detects whether or not an insertion sheet I is set in the insertion sheet storage portion 20. An insertion sheet I having been fed is conveyed by conveyance rollers 23, 24, 25 and 26 to the conveyance roller 2.

(Operation of the Image Forming Apparatus)

An original P is set in the read-sheet feeding portion 101, a user gives desired settings by using the operating portion 40 and specifies the start of operation. Thereby, the operation of image forming onto a sheet S is started. Synchronously with reading of the original P by the read-sheet feeding portion 101, in the image forming apparatus mainbody 102 starts the feeding operation of a sheet S from a specified one of the sheet storage portions 53 and 54, and conveys the sheet S to the image forming portion 162 through the sheet conveyance path 57.

A toner image having been formed by the image forming portion 162 in accordance with image information read by the read-sheet feeding portion 101 is transferred onto the fed sheet. The sheet S is then passed through a fixing portion 164, and fixed on the sheet S. Then, using the sheet processing apparatus 103, the processings of conveyance of an insertion sheet I, punching, sheet-sorting, and stapling, whereby a final output sheet can be obtained.

(Description of the Punching Device)

The punching device 50 will be described herebelow by reference to FIG. 2.

Figure 3:
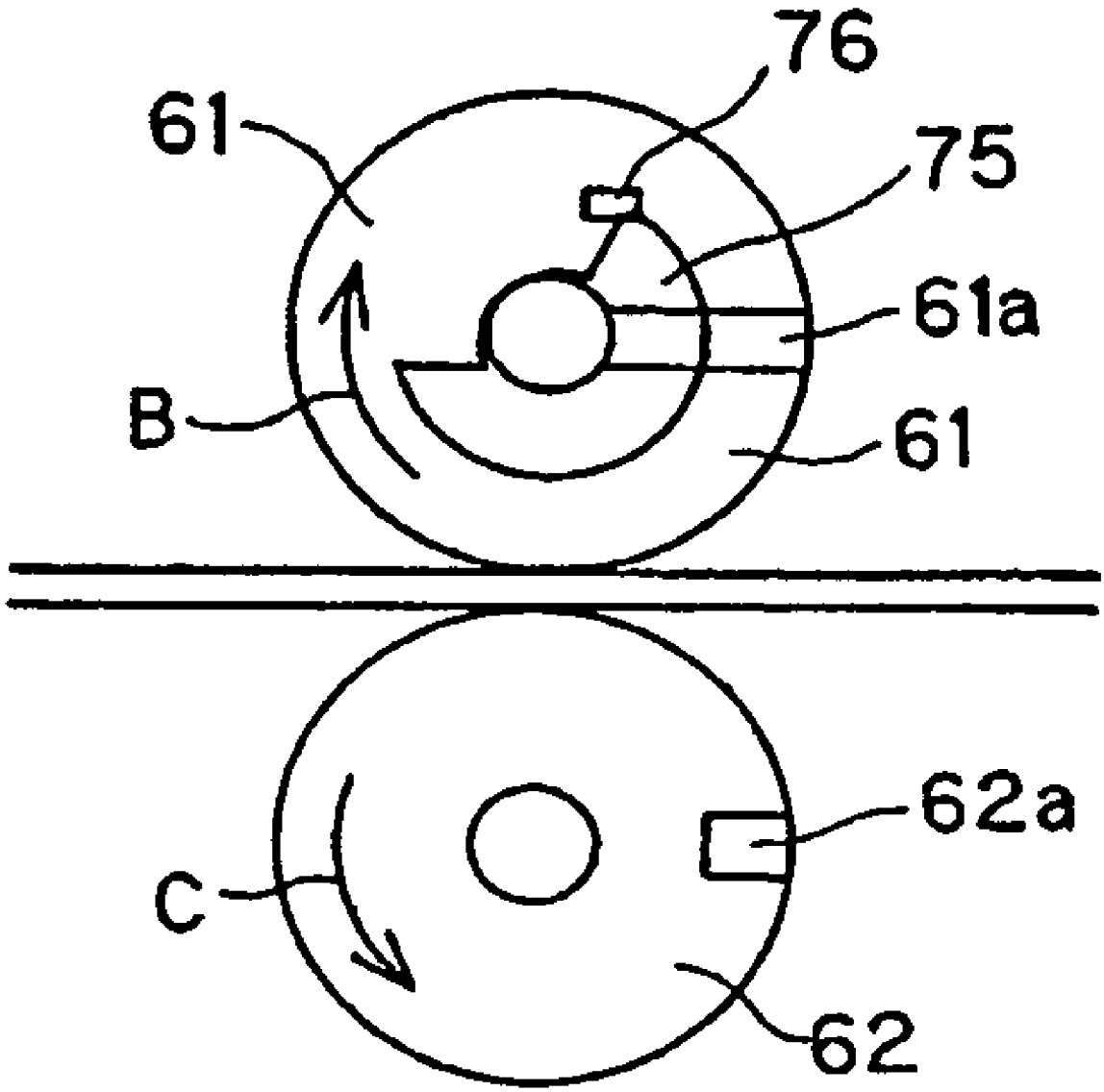
FIG. 3 is a side view of a punch and a die in HP.

The punching device 50 has a punch unit 60 and side-registration detecting portion 80. In the punch unit 60, two pairs of punches 61 and dies 62 are supported to a casing 63 through a support axis, and gears (not shown) fixed to individual support axes engage with one another, wherein they are driven by a punch driving motor (not shown) to be synchronously rotatable in the directions of arrows B and C (FIG. 3). In the present embodiment, although the punch unit having the two pairs of punches 61 and dies 62 are described and shown, more punches and dies may of course be provided.

Figure 4:
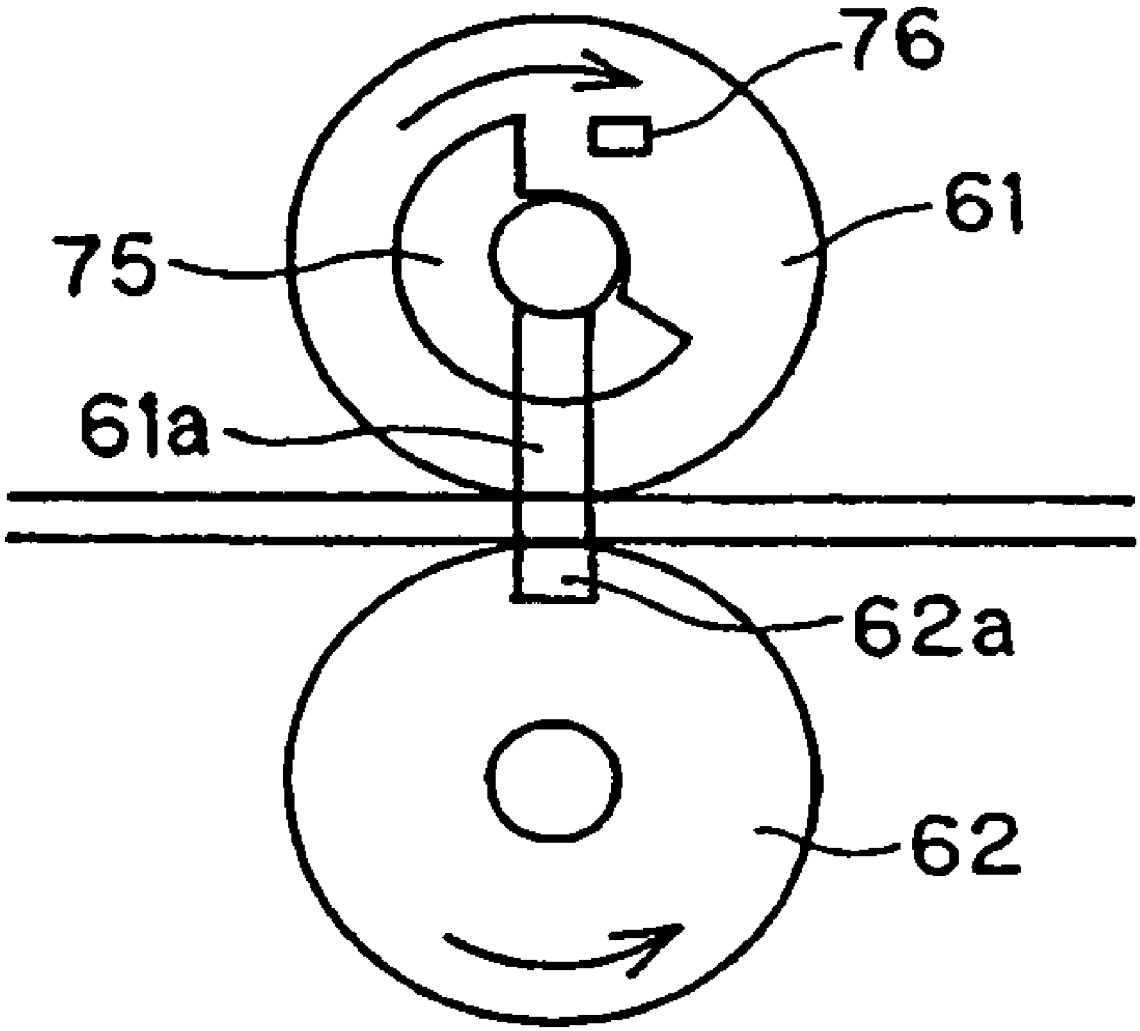
FIG. 4 is a side view of the punch and the die during punching.

Ordinarily the punch 61 and the die 62 stay at a home position (HP) shown in FIG. 2. After a sheet detecting sensor 31 has detected a sheet trail edge, the punch driving motor is driven at a predetermined timing. Thereby, as shown in FIG. 3, the punch 61 and the die 62 are rotated in the directions of arrows B and C, respectively. Then, as shown in FIG. 4, the punch 61 engages a die hole 62*a* provided in the die 62, whereby a hole is punched at a position parallelly spaced a predetermined distance (amount) away from the sheet trail edge of the sheet S being conveyed.

In this case, the rotation rates of the punch 61 and the die 62 are set identical with the rotation rate of the conveyance roller 3 (refer to FIG. 1), thereby to enable hole punching of the sheet S being conveyed.

A punch-unit moving device will be described next. Referring to FIG. 2, a rack gear 63*a* is formed in a part of the casing 63, and is engaged with a pinion gear 70 provided to a punch-unit moving motor (not shown). A punch-unit initial position sensor 71 has a light receiving portion 71*a* provided parallel to a conveyance direction A (shown by an void arrow in FIG. 2) of the sheet S, and is provided in the casing 63.

Accordingly, when the punch-unit moving motor is driven, the punch unit 60 becomes movable in the directions of arrow D and E substantially perpendicular to the conveyance direction A of the sheet S. Moving the punch-unit initial position sensor 71 along the arrow E direction enables the light receiving portion 71*a* to detect a punch slide HP member 35 provided in the mainbody of the sheet processing apparatus 103. In this case, the initial position of the punch unit 60 is assumed to be several millimeters short of a sheet reference position of the punch unit 60, which corresponds to a skew amount of the sheet S, an offset amount of the side registration.

The side-registration detecting portion 80 serving as sheet-edge detecting means is mounted to the punch unit 60. The side-registration detecting portion 80 has a sheet-edge detecting sensor 93 that is mounted to one end of the sensor arm 82 and that detects side edge of the sheet S.

The sensor arm 82 constitutes driving portion such that a rack gear 82*a* is formed in a portion of the sensor arm 82 to engage a pinion gear 83 that is provided to a side-registration moving motor (not shown) provided in the casing 63. In addition, a side-registration initial position sensor 84 having the light receiving portion 84*a*, which is provided in a position opposite the sheet-edge detecting sensor 93, is mounted to the rear end (other end) of the sensor arm 82.

Accordingly, when the side-registration moving motor is driven, the sheet-edge detecting sensor 93 and the side-registration initial position sensor 84 become movable in the direction of the arrows D and E substantially perpendicular to the conveyance direction A of the sheet. Moving the side-registration initial position sensor 84 along the arrow E direction enables the light receiving portion 84*a* to detect a side-registration initial position defining portion 63*b* provided in the casing 63. In addition, by moving the sheet-edge detecting sensor 93 along the arrow D direction, it can be positioned to a position corresponding to a selected sheet size beforehand. This reduces the amount of movement for detecting the side edge of the sheet. The above-described position corresponding to the sheet size refers to an offset position outwardly offset by a predetermined amount, which corresponds to the skew amount of the sheet S, the side-registration offset amount, or the like, from the side edge corresponding to the specified sheet width. By moving the sheet-edge detecting sensor 93 from the above-described position to the arrow D direction, skew and offsetting occurring during sheet conveyance can be addressed.

Operation is performed when detecting a side edge of a sheet. After the sheet detecting sensor 31 has detected a lead edge of a sheet, the punch-unit moving motor (not shown) is driven at a predetermined timing, and the punch unit 60 and the sheet-edge detecting sensor 93 are moved along the arrow D direction. When being blocked by a side edge of the sheet, the sheet-edge detecting sensor 93 recognizes the object to be a side edge of the sheet and then stops. Accordingly, the hole punching position of the sheet S can be aligned at a predetermined distance from the side edge of the sheet. With the sheet-edge detecting sensor 93 thus movably provided, a variety of sheet sizes can be handled with a sensor having a shorter linear dimension in the direction perpendicular to the sheet conveyance direction shorter than a stationary sheet-edge detecting sensor. A predetermined timing after detecting of the sheet lead edge is determined in accordance with a time required for a below-described skew correction. Thereby, the sheet-side-edge detecting is performed after completion of the skew correction, so that the sheet-side-edge detecting is not influenced by the skew.

Figure 5:
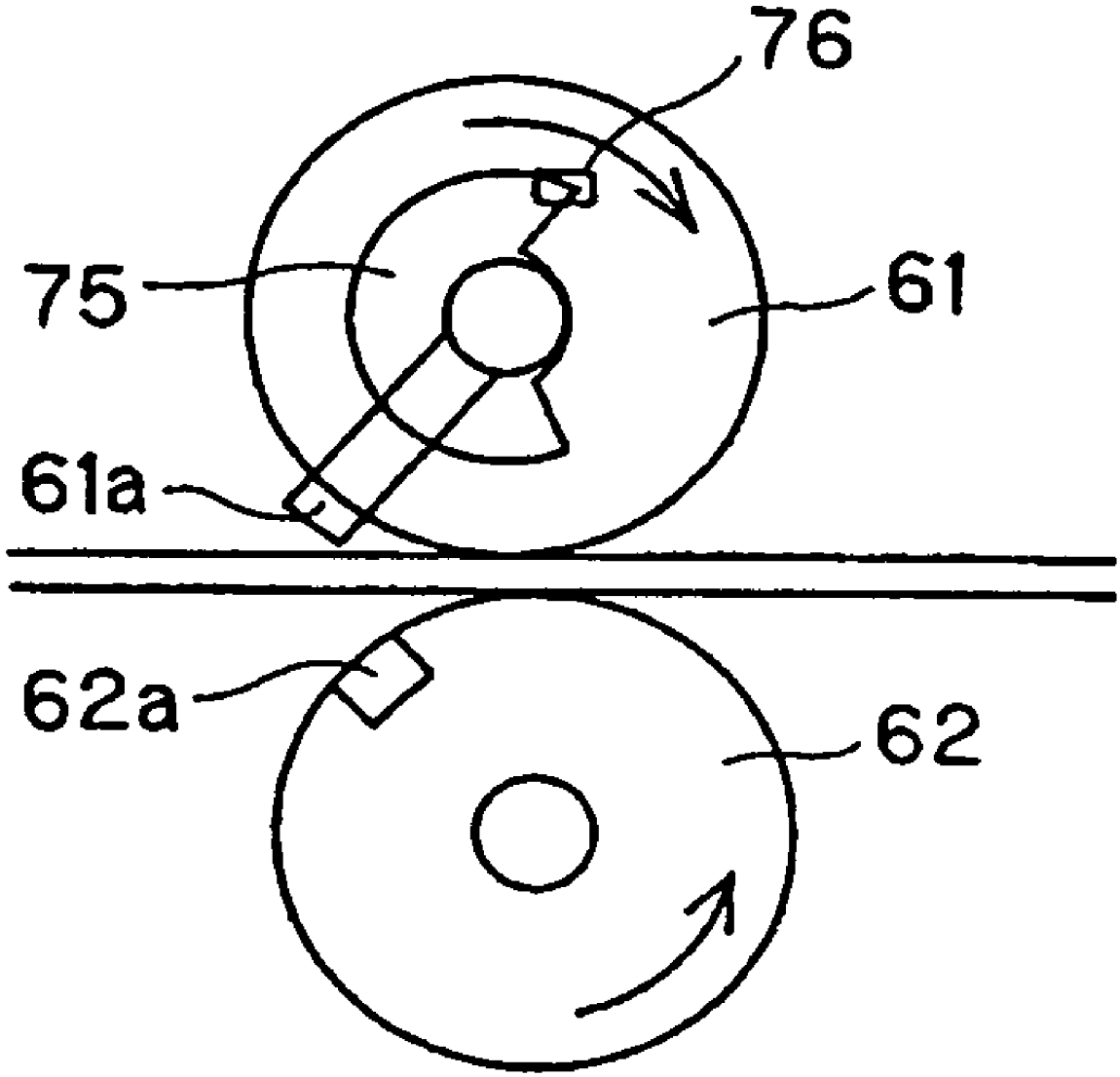
FIG. 5 is a side view of the punch and the die after termination of punching.

As shown in FIG. 3, a flag 75 is secured to a support axis of the punch 61, wherein the rotation of the punch 61 is detected by a punching position sensor 76 (punching operation detecting means). FIG. 3 shows the home position (HP) of the punch 61; FIG. 4 shows the punch 61 and the die 62 during hole punching; and FIG. 5 shows the punch 61 and the die 62 after termination of hole punching.

(Description of Skew Correcting Portion)

The skew correcting portion will now be described herebelow with reference to FIG. 2.

A registration roller pair 301*a* and 301*b* serving as skew correcting portion is used to perform registration of sheet postures and positions, and is disposed on the downstream side of the punching device 50. The registration roller pair 301*a* and 301*b* plays the roll of performing sheet skew correction. As shown in FIG. 2, the registration rollers 301*a* and 301*b* are disposed at a predetermined interval along the direction substantially perpendicular to the conveyance direction A.

Further, the registration roller 301*a* and 301*b* in pairs are, respectively, driven by a first drive motor M1 and a second drive motor M2 that are independent of each other. The registration roller pair 301*a*, 301*b* and the first and second drive motors M1 and M2 together constitute the skew correcting portion. The registration rollers 301*a* and 301*b* in pairs hereafter will be generically referred as "registration roller pair 301" depending on the case. According to the present embodiment, the registration roller 301*a* and 301*b* in pairs are thus independently driven to perform the sheet skew correction. However, equivalent effects can be obtained even with a skew correcting portion differently constructed such that, for example, the registration roller pair 301*a* and 301*b* is movable substantially perpendicular to the conveyance direction A.

Passage sensors 304*a* and 304*b* serving as skew amount detecting means are used to detect a sheet passing through the punching device 50. As shown in FIG. 2, the passage sensors 304*a* and 304*b* are disposed substantially perpendicular to the conveyance direction A at a predetermined interval therebetween.

Upon detecting of a lead edge of a sheet S, the two passage sensors 304*a* and 304*b* individually outputs detected signals (representing skew amount information) to a controller circuit portion 200. The detected results of the passage sensors 304*a* and 304*b* are each used by a controller portion 205 of the sheet processing apparatus to obtain the skew amount of the sheet S (skew amount detecting portion). In the present embodiment, practically, the passage sensors 304*a* and 304*b* are each constructed of a light transmission sensor. The passage sensors 304*a* and 304*b* hereafter will be generically referred to as "passage sensor 304" depending on the case. In the present embodiment, whereas the registration roller pair 301*a* and 301*b* is disposed on the downstream side of the punching device 50, the registration roller pair 301*a* and 301*b* may be disposed on the upstream side of the punching device 50.

(Description of Controller Portion)

Figure 7:
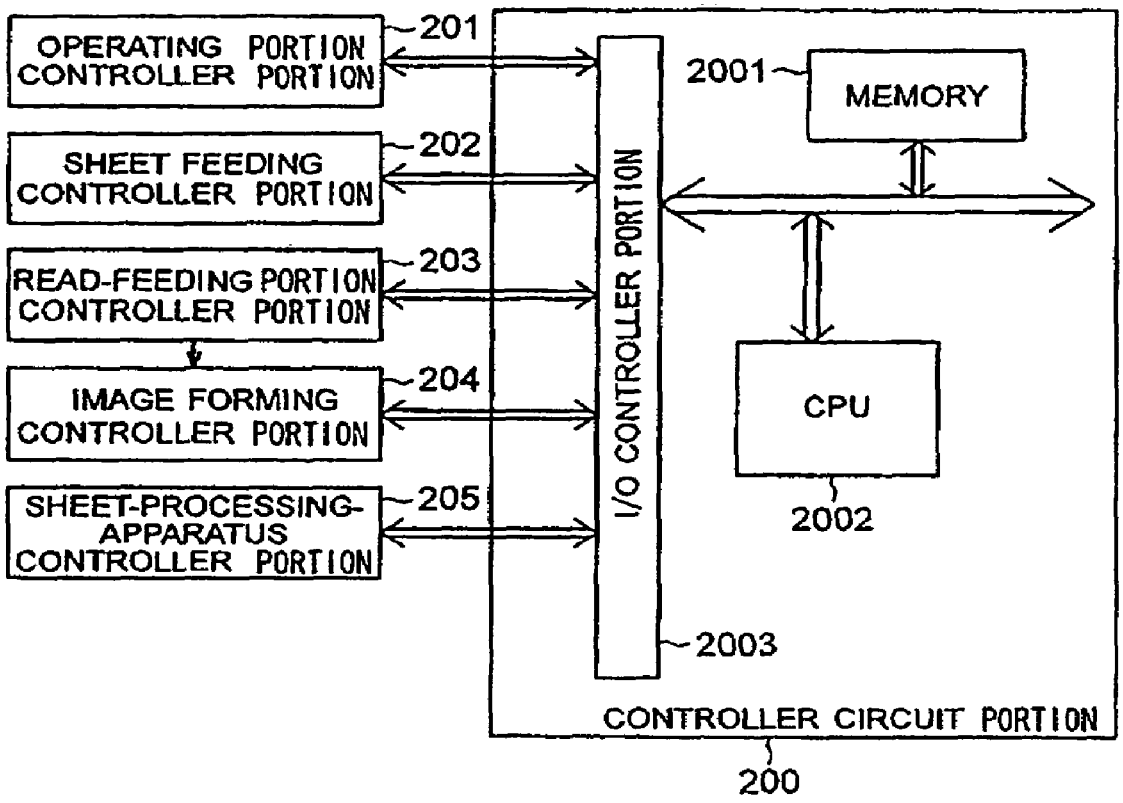
FIG. 7 is a block diagram illustrating control of the sheet processing apparatus and the image forming apparatus mainbody.

FIG. 7 is a block diagram illustrating the controller portion by way of an example of the present embodiment.

The controller circuit portion 200 is configured to include, for example, a central-processor arithmetic portion 2002 (which hereafter will be referred to "CPU") that performs arithmetical operations in accordance with predetermined programs and totally controls processing portions and or sections; a memory 2001 that includes a ROM (read-only memory) for storing programs predetermined data, and the like; a RAM (random access memory) for temporarily storing data in accordance with signal processing, or an IC card and/or a floppy (registered trademark) disk and that is used to perform data reading/writing; and an I/O (input/output) controller portion 2003 that transmits and controls I/O signals. The memory 2001 and the I/O controller portion 2003 are individually controlled in accordance with control signals being issued from the CPU 2002.

The controller circuit portion 200 activates members such as an operating-portion controller portion 201, a recording sheet feeding controller portion 202, a read-feeding-portion controller portion 203, an image forming controller portion 204, and the sheet-processing-apparatus controller portion 205 to operate.

When a user sets an original(s) on an automatic original feeding portion 51 of the read-sheet feeding portion 101 (see FIG. 1) and carries out setting of operations and specification of the start of copying by using the operation portion 40, the automatic original feeding portion 51 feeds the original P one by one, and the optical system 52 reads it.

An exposed original image is photoelectrically converted and read as an electric signal in the CCD line sensor 175. In accordance with user settings from the operating portion 40, a read image signal undergoes various types of image processes, and the image is then converted to an optical signal.

Thereafter, after having undergone ordinarily steps of electrophotographic processings, namely, charging, exposure, latent-image forming, development, transfer, separation, and fixing, the image is recorded onto a sheet S. The sheet S, on which the image has been formed, is conveyed to the feed-in roller 1 through the conveyor belt 163 and the mainbody conveyance roller 165. The sheet processing apparatus 103 is controlled by the controller circuit portion 200 in accordance with the settings given from the operating portion 40.

The sheet S discharged from the image forming apparatus mainbody 102 is conveyed into the sheet processing apparatus 103. When a punching operation for the sheet S is selected on the operating portion 40, the controller circuit portion 200 activates the sheet-processing-apparatus controller portion 205 to operate. Thereby, the side-registration moving motor (not shown) is activated to move the sheet-edge detecting sensor 93 to a predetermined position corresponding to the sheet size prior to the start of sheet feeding (see FIG. 2). The aforementioned predetermined position refers to a position outwardly offset by a predetermined amount from the sheet width corresponding to the sheet size.

The passage sensors 304*a* and 304*b* detect the passage of the sheet S being conveyed, and output detected signals to the controller circuit portion 200. In accordance with the detected signals, the controller circuit portion 200 first calculates a tilt of the lead edge of the sheet S. Subsequently, the controller circuit portion 200 controls the individual rotation rates of the first drive motor M1, which drives the registration roller 301*a*, and the second drive motor M2, which drives the registration roller 301*b*, thereby to perform skew correction.

For example, in such a case as shown in FIG. 2, skew correction is performed in the manner that the registration roller 301*b* on the advanced side is delayed (the rotation rate of the first drive motor M1 is reduced).

The skew correction will be described in more detail herebelow.

The pulse rate of the skew correction is calculated in accordance with the skew amount, conveyance amount in units of one pulse (i.e., per pulse), conveyance speed, and correcting time. For example, in the case of two-phase excitation driving of a two-phase hybrid stepping motor, it performs one rotation in 200 pulses (200 pulses/rotation ("rot," hereafter)), that is, it moves 1.8 degrees per pulse (360 degrees/200 pulses). It is now assumed that a roller having a diameter of 20 mm is mounted to a shaft of the motor, and a sheet is conveyed by that roller. In this case, a conveyance amount of 62.8 mm ($=20\times\pi$) as per one rotation of the motor shaft can be obtained.

In one pulse, the conveyance amount is 0.314 mm (=20×π mm/rot÷200 pulses/rot). When the skew amount is now assumed to be 6.28 mm, it therefore corresponds to the amount in 20 pulses. Conversely, suppose that the conveyance speed of the sheet is 314 mm/s. In this case, the rotation rate of the motor with the 20 mm diameter roller is 5 rps (=314 mm/s÷20π mm/rot). In terms of the pulse rate, the above rate is equivalent to 1000 pps (pulse per second).

The rotation angle per pulse is different depending on, for example, the type and excitation method of the stepping motor. A representative example is shown hereinbelow. In the case of a two-phase excitation driving of a two-phase hybrid stepping motor, the rotation angle is 1.8 deg/pulse. In the case of one-two phase excitation driving of the two-phase hybrid stepping motor, the rotation angle is 0.9 deg/pulse. In the case of four-phase excitation driving of a five-phase hybrid stepping motor, the rotation angle is 0.72 deg/pulse. In the case of four-five phase excitation driving of the five-phase hybrid stepping motor, the rotation angle is 0.36 deg/pulse.

A motor clock frequency f during normal conveyance and a motor clock frequency fr at the time of skew correction are represented as follows:

$$f=V+(\pi 1)\times S \quad \text{[pps]}$$

$$fr=f-(n/t) \quad \text{[pps]}$$

where, f=Motor clock frequency during normal conveyance;

fr=Motor clock frequency at the time of skew correction;

n=Skew-amount pulse equivalency (=d/((πl )×S));

d=Skew amount (mm)

l=Roller diameter (mm)

S=Number of pulses ("pulse number," hereafter) as per one rotation;

V=Conveyance speed (mm/s); and t=Correcting time.

The correcting time t is a time from the start of the correction to the termination thereof, and is physically in accordance with the structure of a corresponding conveyance path. For example, in a case where the conveyance speed is 314 mm/s and the correction is desired to terminate within a distance of 31.4 mm, the correcting time is 0.1 s.

As a practical example, a case is now contemplated wherein when a motor is being driven at 1000 pps, a skew of 6.28 mm is corrected within 0.1 s (the deep side is assumed to be delayed). In such a case, the deep side motor is kept driven at 1000 pps. On the other hand, the near side motor is 0.1 s driven after the rotation rate has once been reduced from 1000 pps to 800 pps.

Thereafter, the rotation rate is returned to 1000 pps. According to the execution of such control, a near side of the sheet is conveyed with a delay of 6.28 mm. While being 0.1 s driven at 800 pps, the sheet is advanced by 31.4 mm.

The coefficient is a numeric value obtained from experiments, and is stored in the memory in the form of a table.

In accordance with the principle described above, the skew correction can be implemented in the manner that the controller circuit portion 200 drives the sheet-processing-apparatus controller portion 205 to operate and thereby to control the rotation speed rates of the first and second drive motors M1 and M2. However, in the case of a large skew amount, the rotation rate should of course be greatly reduced, so that it is predictable that the motor itself becomes unable to follow such operation. As such, in practice, the motor rotation speed rate is gradually changed, thereby to change the conveyance amounts of the deep side and near side of the sheet. Control to be performed when performing gradual reduction of the rotation rate (deceleration) will be described herebelow by reference to FIGS. 6A and 6B.

Figure 6A:
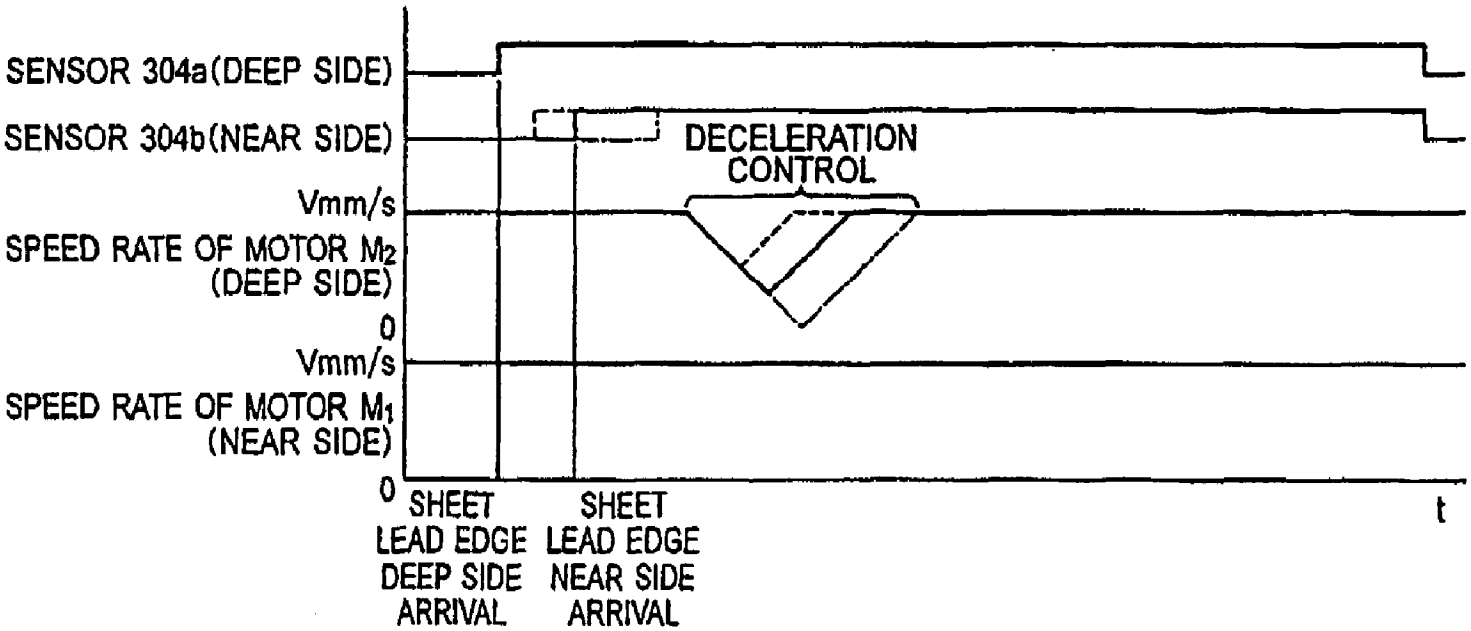
FIGS. 6A and 6B are timing charts related to skew correction.
Figure 6B:
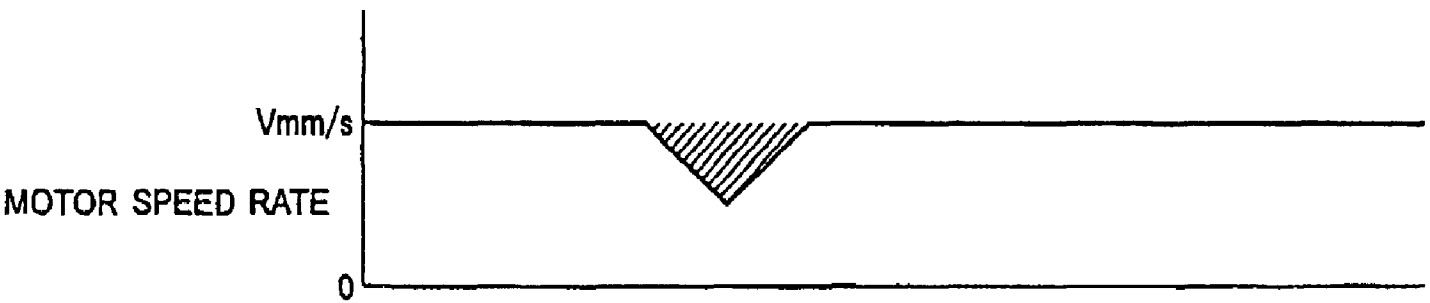

FIGS. 6A and 6B are timing charts each representing the state of the motor deceleration. The difference in the times at which the sheet has arrived at the passage sensors 304*a* and 304*b* is represented by a value reflecting the skew amount. Accordingly, a motor deceleration curve is determined in accordance with the time difference.

As shown in FIG. 6A, the motor deceleration amount changes corresponding to the skew amount. FIG. 6A depicts three cases where the skew amounts are different (broken line: small skew amount; solid line: intermediate skew amount; single-dotted chain line: large skew amount). As shown in FIG. 6B, the part of the area of a deceleration portion (area of a hatched portion) corresponds to a delay part (Δl1) with respect to the movement amount during ordinary-speed conveyance. The delay part is the product of the difference in the motor rotation rates and time.

In the case of a stepping motor, the motor rotation rate corresponds to the difference in the frequencies of clocks being applied thereto. In the case of a DC motor (not shown), the motor rotation rate can be detected by a magnetic encoder or an optical encoder, for example.

After completion of the skew correction, the punch-unit moving motor is driven, and the punch unit 60 and the sheet-edge detecting sensor 93 are moved along the direction intersecting with the sheet conveyance direction. When the sheet-edge detecting sensor 93 has detected a side edge of the sheet, the controller circuit portion 200 stops the punch-unit moving motor; that is, it stops the punch unit 60 and the sheet-edge detecting sensor 93. The timing of the sheet-edge detecting by the sheet-edge detecting sensor 93 is thus set to be after the completion of the skew correction, so that the side-edge of the sheet can be accurately detected. According to the present embodiment, the timing of the sheet-edge detecting is thus set so that the skew correction is completed after the passage of a predetermined time after the sheet detecting sensor 31 has detected the lead edge of the sheet. However, the arrangement may be such that the correcting time t necessary for the skew correction is determined in accordance with the tilt of the lead edge of the sheet S which tilt has been calculated in accordance with the detected signals received from the passage sensors 304*a* and 304*b*, thereby to determine the completion of the skew correction. In this case, compared to the manner of fixedly setting the time necessary for the skew correction, the time practically necessary for the skew correction can be determined. Accordingly, a margin is produced in the subsequent sheet-side-edge detecting, so that secure sheet-side-edge detecting and the positioning of the punch unit 60 can be implemented.

After the sheet trail edge was detected by the sheet detecting sensor 31 and has then been conveyed a predetermined distance, the controller circuit portion 200 activates the punch driving motor (not shown) to drive the punch unit 60 to operate. Thereby, hole punching is performed in a position spaced away at a predetermined amount in parallel from the sheet trail edge of the sheet S. In the present embodiment, the sheet detecting sensor 31 is disposed on a more upstream side than the registration roller pair 301 in the sheet conveyance direction, and concurrently is disposed in a position allowing the sheet trail edge to pass by the sheet detecting sensor 31 after completion of the skew correction. With the sheet detecting sensor 31 thus disposed in the above-described position, the construction in the vicinity of the punching device can be made compact. As described above, according to the present embodiment, hole punching is performed by activating the punch driving motor after the sheet is conveyed the predetermined distance after the sheet trail edge is detected by the sheet detecting sensor 31. However, the hole punching may be performed after the sheet is conveyed a predetermined distance corresponding to the sheet size after the lead edge of the sheet is detected by the sheet detecting sensor 31. This enables the detecting of the lead edge of the sheet to server as a trigger for the start of operation of both the punch-unit moving motor and the punch driving motor.

When the punching position sensor 76 has detected a punch HP position, the controller circuit portion 200 activates the sheet-processing-apparatus controller portion 205 to cause the punch driving motor to stop, thereby stopping the punch unit 60. Further, the controller circuit portion 200 activates the sheet-processing-apparatus controller portion 205 to drive the punch-unit moving motor, thereby moving the punch unit 60 and the sheet-edge detecting sensor 93 to a punch slide HP position on the opposite side with respect to the sheet S.

The controller circuit portion 200 activates the sheet-processing-apparatus controller portion 205 to activate a conveyance flapper 11 (FIG. 1) to operate, thereby to shift a conveyance path. When stacking the sheet S on a sample tray 95, the sheet S is discharged through the discharge roller 9.

When stacking on the stacking tray 96, the sheet S is discharged from the discharge roller 7 through the conveyance roller 6, and is then discharged to the processing tray 92. When a stapling operation is selected in the operating portion 40, the controller circuit portion 200 activates the sheet-processing-apparatus controller portion 205 to activate the stapler unit 90 to operate, thereby performing the stapling processing of recording sheets S stacked on the processing tray.

The controller circuit portion 200 activates the sheet-processing-apparatus controller portion 205 to operate, thereby to activate collating plate 98 to collate a sheet set being stacked and to control the sorting direction of the sheet set that will be stacked on the stacking tray 96. After having activating the sheet-processing-apparatus controller portion 205 thereby to shut the oscillatory guide 91, the controller circuit portion 200 activates the sheet-edge detecting sensor 93 to operate, thereby causing the sheet set in the processing tray to be discharged to the stacking tray 96 and then to be stacked.

Figure 8:
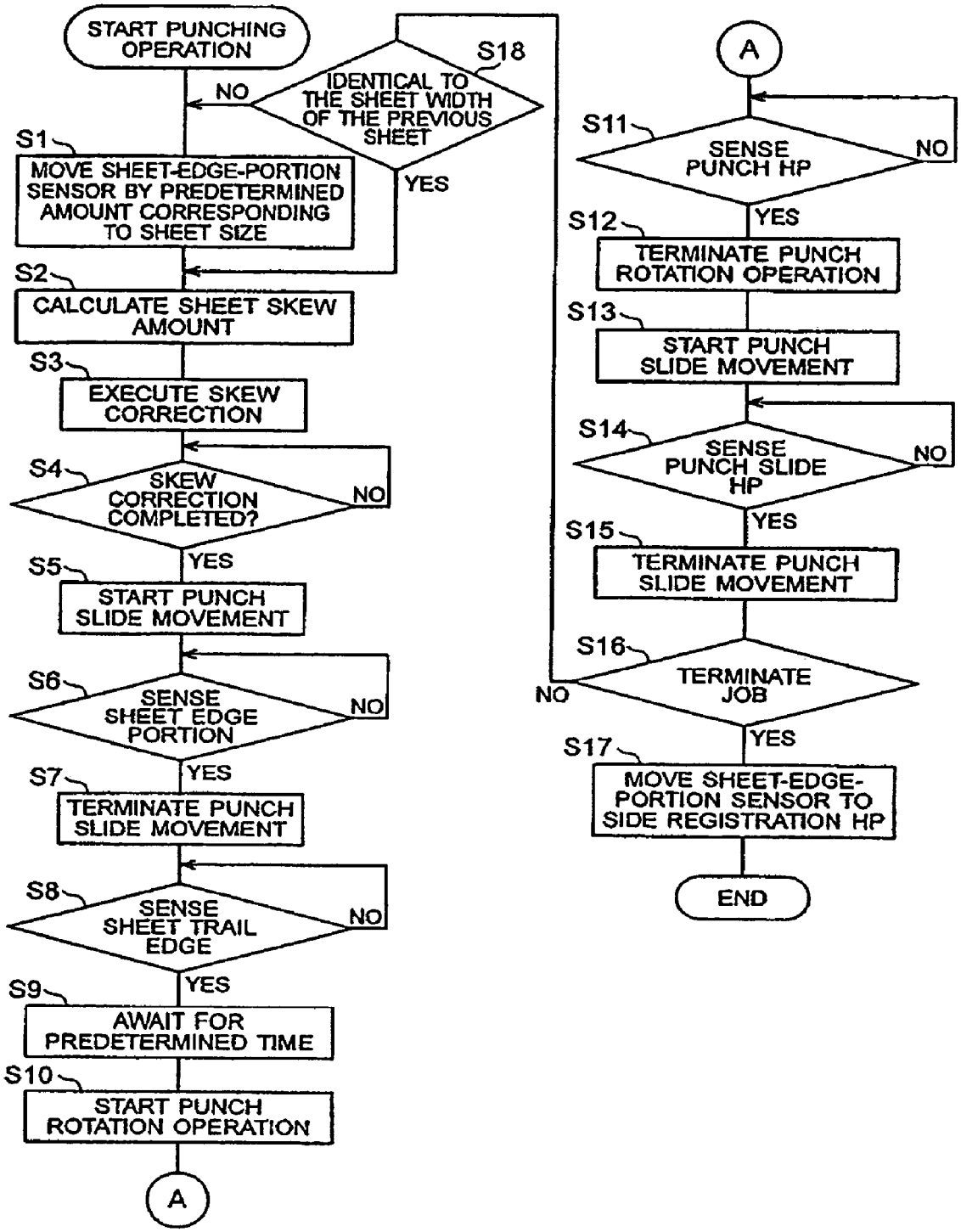
FIG. 8 is a flowchart of operation representing the sheet processing apparatus.

More specific operation of the above-described embodiment will be described herebelow in accordance with a flowchart of FIG. 8.

The CPU 2002, which constitutes the controller circuit portion 200, activates the operating-portion controller portion 201 thereby to accept inputs for the stacking operation, stapling operation, and punching operation. In accordance with the operation settings having been input and specified using the operating portion 40 by a user, the CPU 2002 executes the operations by activating the recording sheet feeding controller portion 202, the read-feeding-portion controller portion 203, the image forming controller portion 204, and the sheet-processing-apparatus controller portion 205.

When a user has executed a copy start operation by selecting the punching operation, the CPU 2002 activates the sheet-processing-apparatus controller portion 205 to activate the side-registration moving motor (not shown), thereby moving the sheet-edge detecting sensor 93 in position to a predetermined position corresponding to the sheet size (S1 ("S" stands for "step")). When the passage sensors 304*a* and 304*b* have detected a lead edge of a sheet, the CPU 2002 calculates the tilt (skew amount) of the sheet in accordance with sensor outputs (S2).

Next, the skew correction of the sheet is performed in accordance with the skew amount (S3). Since the details of the skew correction have already described in the above, they will be omitted herefrom. In the present embodiment, the skew correction is performed in the manner that the registration roller 301 on the advanced side is delayed.

Subsequently, it is determined whether the skew correction has been completed (S4), the punch-unit moving motor is activated (S5), and the punch unit 60 is moved along the sheet-width direction until the sheet-edge detecting sensor 93 detects a side edge of the sheet (S6). When the sheet-edge detecting sensor 93 has detected the sheet side edge, the CPU 2002 causes the movement of the punch 61 in the sheet-width direction to stop (S7).

The operation is thus arranged to cause the sheet-edge detecting sensor 93 to detect the sheet side edge after completion of the skew correction for the reason that the position in the direction intersecting with the sheet conveyance direction of the sheet side edge changes during the skew correction. The CPU 2002 awaits an case where the sheet detecting sensor 31 detects a trail edge of the sheet (S8).

When the trail edge of the sheet has been detected, the CPU 2002 awaits for a predetermined time so that the punching position comes to a predetermined punching position with respect to the sheet conveyance direction (S9). The CPU 2002 activates the sheet-processing-apparatus controller portion 205 thereby to activate the punch driving motor operate, thereby performing hole punching on the sheet being conveyed (S10).

When the punching position sensor 76 has detected the punch HP (S11), the CPU 2002 causes the rotation of the punch 61 to stop (S12).

The CPU 2002 activates the sheet-processing-apparatus controller portion 205 thereby to activate the punch-unit moving motor (S13). When a punch slide HP sensor 71 (punch slide HP detecting means) has detected the HP (standby position) of the punch unit 60 (the punch 61 and the die 62) (S14), the CPU 2002 causes slide movement of the punch unit 60 (S15).

The CPU 2002 determines whether or not the job has terminated (S16). If the case of having determined that the job has terminated, the CPU 2002 activates the sheet-processing-apparatus controller portion 205 to activate the side-registration moving motor (not shown), thereby to cause the sheet-edge detecting sensor 93 to be moved in position to a side registration HP position (S17). Then, the CPU 2002 terminates the operation.

At S16 in the case of having determined that the job continues, the CPU 2002 determines whether or not the sheet width of a subsequent sheet S is identical to the sheet width of the previous sheet (S18). In the case of having determined that the sheet widths are identical to each other, the CPU 2002 executes the S2 processing. At S18 in the case of having determined that the sheet widths are different from each other, the CPU 2002 executes the S1 processing. In the present embodiment, whereas the CPU 2002 (controller circuit portion 200) controls the sheet processing apparatus 103 through the sheet-processing-apparatus controller portion 205, the arrangement may be such that the CPU 2002 directly controls the operation of the sheet processing apparatus 103.

Second Embodiment

In the first embodiment, the skew correction is performed in the state where the trail edge of the sheet is nipped by a conveyance roller pair 302. In this case, when the skew amount is large, deflection of the sheet between the registration roller pair 301 and the conveyance roller pair 302 is enlarged. The arrangement may be as described herebelow as a method for reducing the deflection.

Figure 9:
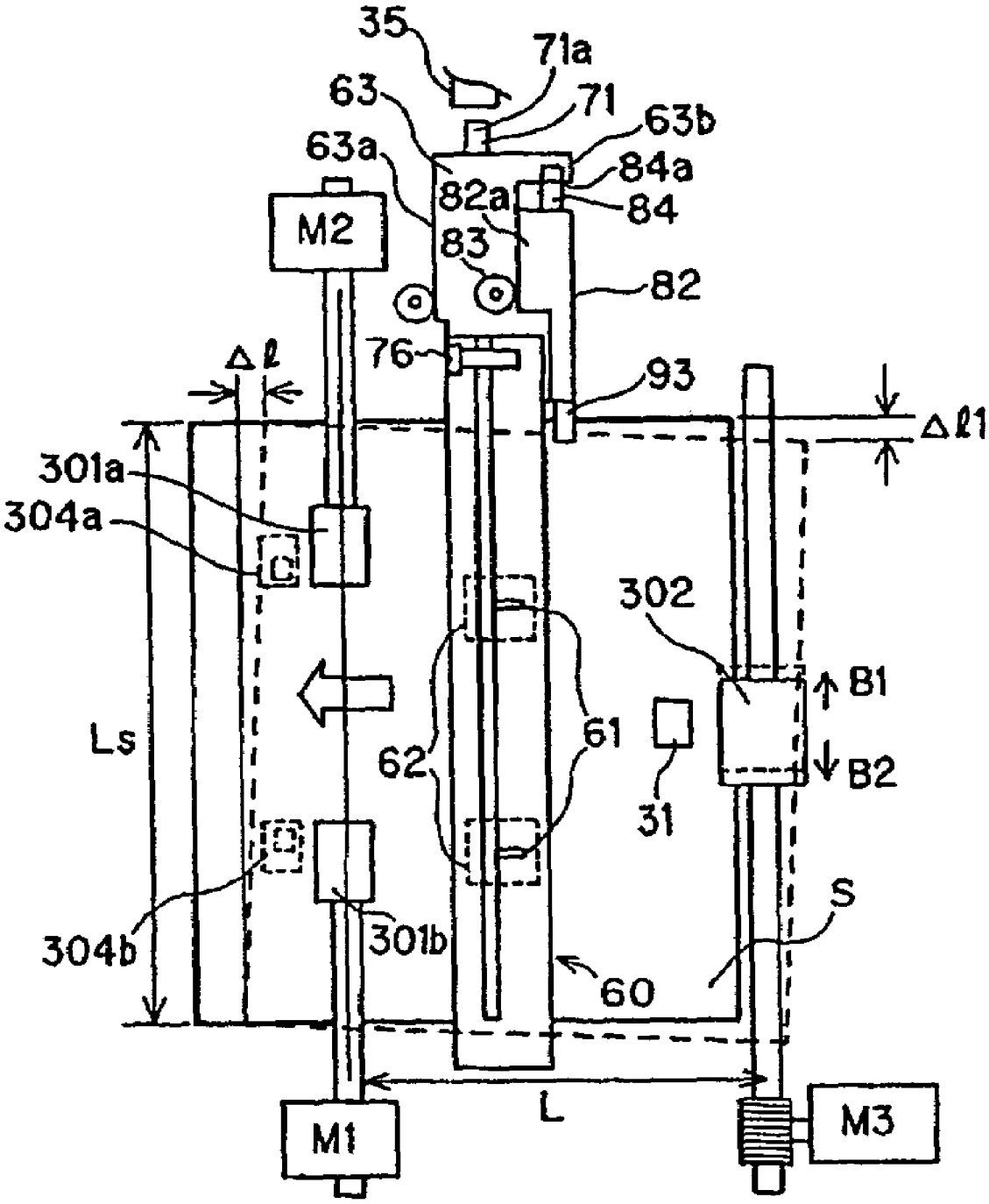
FIG. 9 is a plan view of a punch unit and a skew correcting portion according to a second embodiment of the invention.

Referring to FIG. 9, the conveyance roller pair 302 on the upstream side of the registration roller pair 301 in the sheet conveyance direction is configured to be movable in the direction intersecting with the sheet conveyance direction. In this configuration, during the skew correction by using the registration roller pair 301, the conveyance roller pair 302 is moved by a predetermined amount along the direction intersecting with the sheet conveyance direction in correspondence to the amount of skew correction. Thereby, the deflection of the sheet between the registration roller pair 301 and the conveyance roller pair 302 is minimized, and the skew correction can be implemented with even higher accuracy.

In accordance with the tilt of the lead edge of the sheet S, a movement control amount of the registration roller pair 301 is calculated by the CPU 2002. A third drive motor M3 is rotated corresponding to the obtained movement control amount, thereby to move the conveyance roller pair 302 in a thrust direction (moving device).

For example, the state illustrated in FIG. 9 is now contemplated. The conveyance roller pair 302 is moved by Δl1 in the direction (direction B1 shown in the drawing) substantially perpendicular to the sheet conveyance direction. Thereby, the sheet S under the skew correction by the registration roller pair 301 is moved to the direction substantially perpendicular to the sheet conveyance direction, consequently enabling the skew correction to be implement with high accuracy.

The movement amount Δl1 of the conveyance roller pair 302 is approximately represented as:

$$\Delta l1 = L/Ls \times \Delta l$$

where,

Δl1=Movement amount of the conveyance roller pair 302;

L=Distance from the registration roller pair 301*a* and 301*b* to the conveyance roller pair 302;

Ls=Width of the sheet S; and

Δl=Tilt of the lead edge of the sheet S.

The skew is corrected by thus moving the conveyance roller pair 302 along the thrust direction. Even after this event, the sheet is conveyed. As described above, according to the present embodiment, the conveyance roller pair 302 is moved by the predetermined amount, thereby to minimize the deflection of the sheet between the registration roller pair 301 and the conveyance roller pair 302. However, equivalent or similar effects can be obtained even in a case where, two independent roller pairs are used for the conveyance roller pair 302 as in the case of the registration roller pair 301 in the first embodiment.

As described above, upon completion of the skew correction, detecting of the side edge by the sheet-edge detecting sensor 93 is started.

When the sheet detecting sensor 31 has detected the trail edge of the sheet S, in accordance with a detected signal therefrom, the CPU 2002 detects that the trail edge of the sheet S has passed through the conveyance roller pair 302. Then, the CPU 2002 causes the third drive motor M3 to perform reverse rotation.

The reverse rotation of the third drive motor M3 causes the conveyance roller pair 302 to move along a direction B2 shown in FIG. 9. Then, when the conveyance roller pair 302 has returned to the home position, the CPU 2002 stop the activation of the third drive motor M3, and enters in the standby state to await for subsequent sheet skew correction. Whether or not the conveyance roller pair 302 has returned to the home position is determined in accordance with an output signal of a microswitch (not shown).

Thus, the thrust position of the conveyance roller pair 302 is controlled when performing the skew correction by using the registration roller pair 301*a* and 301*b*. Thereby, the movement in the rotation direction corresponding to the overall skew correcting direction of the sheet S is assisted and the movement thereof is not disturbed, so that the skew correction can be performed with even higher accuracy.

Preferably, the rotation rate and rotation/stopping timing of the third drive motor M3 is synchronized with the movement in the direction of rotation of the sheet S by the first and second drive motors M1 and M2. At least, the selection thereof is made to cause the operation to terminate during the skew correcting operation by the first and second drive motors M1 and M2.

Third Embodiment

Figure 10:
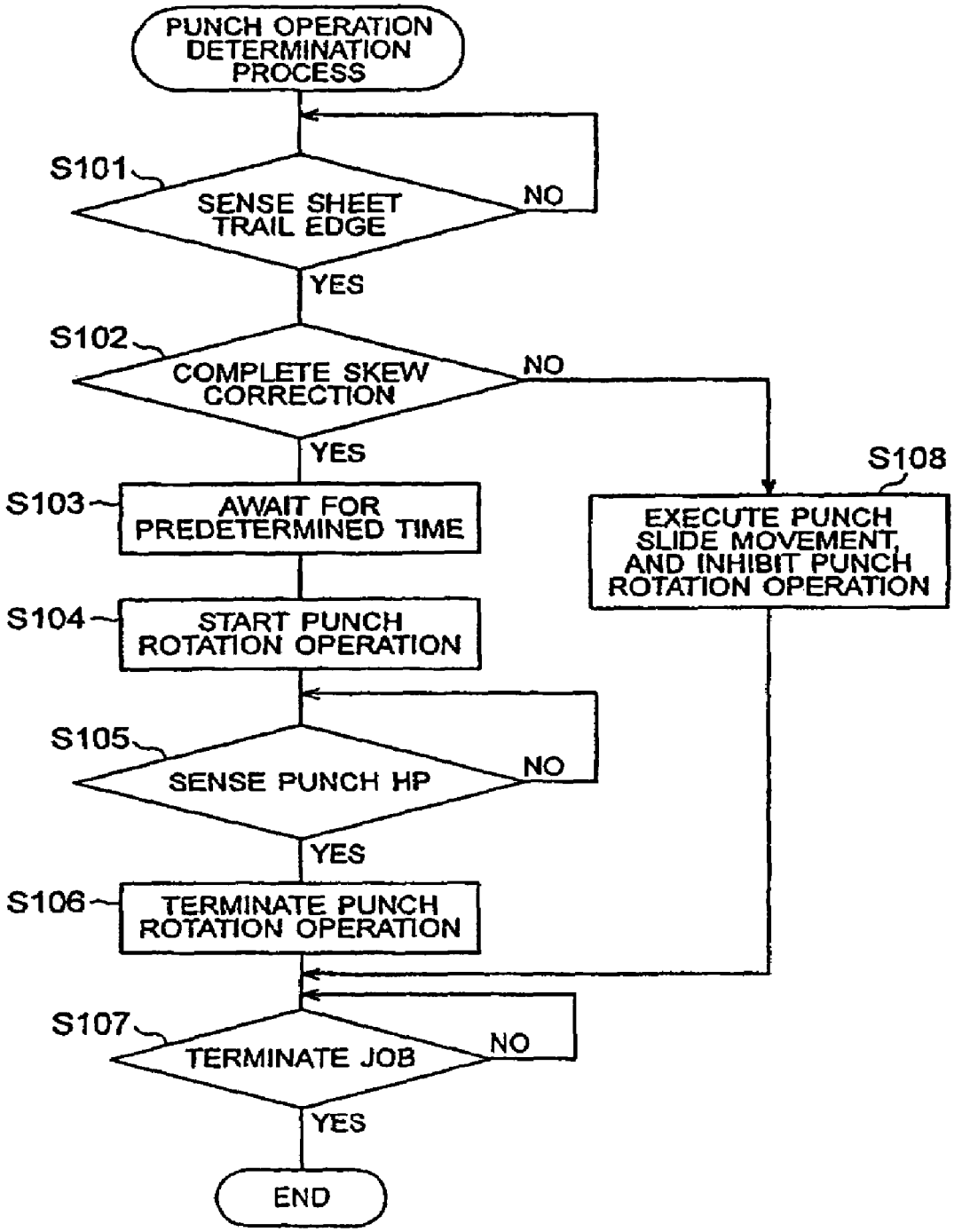
FIG. 10 is a flowchart representing operation of a sheet processing apparatus.

As the skew is larger, it takes a longer time for the skew correction. As such, when the skew of the sheet is large in a construction of the type shown in FIG. 2, a case can be contemplated wherein the trail edge of the sheet reaches the sheet detecting sensor 31 during the skew correction. For this reason, in a construction according to a third embodiment, when the trail edge of the sheet has reached the sheet detecting sensor 31 before termination of the skew correction, the punch processing of that sheet is inhibited. A flowchart regarding this case will be described herebelow by using FIG. 10.

First, it is determined whether or not the sheet detecting sensor 31 has detected a trail edge of a sheet (S101) If the sheet detecting sensor 31 has detected the trail edge of the sheet, then it is determined whether or not skew correction has been completed (S102). If the skew correction has been completed, then the CPU 2002 awaits for a predetermined time so that the punching position comes to a predetermined punching position with respect to the sheet conveyance direction (S103).

The CPU 2002 activates the sheet-processing-apparatus controller portion 205 to activate the punch driving motor, thereby to perform the hole punching of the sheet being conveyed (S104). When the punching position sensor 76 has detected the punch HP (S105), the CPU 2002 causes the rotation of the punch 61 to stop (S106).

If at S102 the skew correction has not yet been completed, then the CPU 2002 inhibits a punch rotation operation (S108). Subsequently, the CPU 2002 determines whether or not the job has terminated (S107). If the job has terminated, then the CPU 2002 goes out of the processing. On the other hand, if the job has not yet terminated, the processing returns to S101. In this processing, if the skew correction is not yet completed even in the state of punch-rotation activation timing, the punch rotation operation is inhibited. In this case, processing such as punch processing at an incomplete position of a sheet or punch processing is performed at a position where no sheet is present (no-load rotation), thereby to prevent wearing of a punch blade.

In addition, since timing of sheet-edge detecting by the sheet-edge detecting sensor 93 is set to be after completion of the skew correction, the position of the side edge of the sheet can be accurately detected.

Further, sheet conveying portion provided on the upstream side of the skew correcting portion in the sheet conveyance direction is constructed to be movable in the thrust direction. Accordingly, the rotation-direction movement of the sheet in the case of skew correcting control can be assisted by controlling the thrust position of the sheet conveying portion. This consequently making it possible to improve the accuracy of the skew correction.

Further, when the sheet detecting sensor 31 has detected the trail edge of the sheet, if the skew correction has not yet terminated, the punching operation is inhibited. As such, for example, processing such as punch processing is performed at an incomplete position of a sheet, thereby to prevent wearing of the punch blade.

The invention is not limited to any one of the embodiments described above. The constructions of the embodiments described above can be combined with one another as long as it is possible.

According to the invention, the skew correction is performed for an object sheet of punch processing even while the sheet is being conveyed. Consequently, the punch processing operation can be implemented with improved accuracy in punching position without reducing the productivity even in comparison to a case where punch processing is not performed.

This application claims priority from Japanese Patent Application No. 2004-85377 filed Mar. 23, 2004 and Japanese Patent Application No. 2005-65415 filed Mar. 9, 2005, which hereby incorporated by reference herein.

What is claimed is:

1. A sheet processing apparatus comprising:

a skew correcting portion which performs skew correction of a sheet while the sheet is being conveyed;

a punch unit which performs punching of the sheet while the sheet is being conveyed;

a punch driving portion which drives the punch unit at a trailing portion of the sheet;

a sheet-edge detecting sensor which performs detection of a sheet edge in a direction intersecting with a sheet conveyance direction;

a punch-unit moving device which moves the punch unit in the direction intersecting with the sheet conveyance direction;

a sheet detecting sensor which performs detection of a sheet position in the sheet conveyance direction; and a controller portion which controls the skew correction of the sheet and a punching operation on the sheet, wherein:

the punch unit is provided on an upstream side of the skew correcting portion in the sheet conveyance direction, the sheet detecting sensor is disposed in a position where a trailing edge of the sheet is detected after termination of the skew correction by the skew correcting portion, the controller portion controls such that after skew of the sheet is corrected by the skew correcting portion, positioning of the punch unit in the direction intersecting with the sheet conveyance direction is performed by the punch-unit moving device in accordance with a detection result of the sheet-edge detecting sensor, and punching is performed on the sheet by the punch driving portion in accordance with a detection result of the sheet detecting sensor, and when the sheet detecting sensor has detected the trailing edge of the sheet before termination of the skew correction by the skew correcting portion, the controller portion inhibits a punching operation by the punch unit.

2. The sheet processing apparatus according to claim 1, further comprising:

a skew amount detecting portion which detects a skew amount of the sheet being conveyed, wherein:

the skew correcting portion comprises two roller pairs which convey the sheet, wherein the individual roller pairs are disposed in the direction intersecting with the sheet conveyance direction; and in accordance with a detection result of the skew amount detecting portion, the controller portion causes conveyance speeds of the individual roller pairs to be different from each other, thereby to perform correction of the skew of the sheet having been conveyed.

3. The sheet processing apparatus according to claim 2, wherein:

the skew correcting portion comprises two drive sources which drive the individual roller pairs independently of each other; and in accordance with the detection result of the skew amount detecting portion, the controller portion controls driving speeds of the individual drive sources, thereby to cause the conveyance speeds of the individual roller pairs to be different from each other.

4. The sheet processing apparatus according to claim 1, wherein:

the sheet-edge detecting sensor moves along the direction intersecting with the sheet conveyance direction, thereby to perform the detection of the sheet edge; and the controller portion controls such that movement of the punch unit and the sheet-edge detecting sensor is started by the punch-unit moving device in accordance with the detection result of the sheet detecting sensor after termination of the skew correction by the skew correcting portion.

5. The sheet processing apparatus according to claim 4, wherein:

the controller portion controls such that the punch-unit moving device is driven after a leading edge of the sheet in the conveyance direction has been detected by the sheet detecting sensor.

6. The sheet processing apparatus according to claim 4, further comprising:

a casing which supports the punch unit, wherein the sheet-edge detecting sensor is movably supported by the casing.

7. The sheet processing apparatus according to claim 6, further comprising:

a casing which supports the punch unit, wherein the sheet-edge detecting sensor is movably supported by the casing.

8. The sheet processing apparatus according to claim 1, further comprising a skew amount detecting portion which detects a skew amount of the sheet being conveyed, wherein:

the sheet-edge detecting sensor moves along the direction intersecting with the sheet conveyance direction, thereby to perform the detection of the sheet edge; and the controller portion performs a calculation of a correcting time necessary for the skew correction of the sheet by the skew correcting portion in accordance with the detection result of the skew amount detecting portion, and controls such that movement of the punch unit and the sheet-edge detecting sensor is started by the punch-unit moving device after passage of the correcting time.

9. The sheet processing apparatus according to claim 1, wherein:

the sheet detecting sensor is provided on an upstream side of the skew correcting portion in the sheet conveyance direction.

10. The sheet processing apparatus according to claim 1, further comprising:

a skew amount detecting portion which detects a skew amount of the sheet being conveyed;

a sheet conveying portion which is provided in an upstream side of the skew correcting portion in the sheet conveyance direction and which conveys the sheet; and a moving device which moves the sheet conveying portion along the direction intersecting the sheet conveyance direction, wherein the controller portion controls an amount of movement of the sheet conveying portion by the moving device, in accordance with the detection result of the skew amount detecting portion.

11. The sheet processing apparatus according to claim 10, wherein:

the controller portion controls a movement of the sheet conveying portion during the skew correcting operation by the skew correcting portion.

12. An image forming apparatus comprising:

an image forming portion which forms an image on a sheet; and a sheet processing apparatus which performs processing on the sheet on which the image has been formed by the image forming portion, wherein the sheet processing apparatus comprises:

a skew correcting portion which performs skew correction of the sheet while the sheet is being conveyed;

a punch unit which performs punching of the sheet while the sheet is being conveyed;

a punch driving portion which drives the punch unit at a trailing portion of the sheet;

a sheet-edge detecting sensor which performs detection of a sheet edge in a direction intersecting with a sheet conveyance direction;

a punch-unit moving device which moves the punch unit in the direction intersecting with the sheet conveyance direction;

a sheet detecting sensor which performs detection of a sheet position in the sheet conveyance direction; and a controller portion which controls the skew correction of the sheet and a punching operation on the sheet, wherein:

the punch unit is provided on an upstream side of the skew correcting portion in the sheet conveyance direction, the sheet detecting sensor is disposed in a position where a trailing edge of the sheet is detected after termination of the skew correction by the skew correcting portion, the controller portion controls such that after skew of the sheet is corrected by the skew correcting portion, positioning of the punch unit in the direction intersecting with the sheet conveyance direction is performed by the punch-unit moving device in accordance with a detection result of the sheet-edge detecting sensor, and punching is performed on the sheet by the punch driving portion in accordance with a detection result of the sheet detecting sensor, and when the sheet detecting sensor had detected the trailing edge of the sheet before termination of the skew correction by the skew correcting portion, the controller portion inhibits a punching operation by the punch unit.

13. An image forming apparatus comprising:

an image forming portion which forms an image on a sheet;

a skew correcting portion which performs skew correction of the sheet while the sheet is being conveyed;

a punch unit which performs punching of the sheet while the sheet is being conveyed;

a punch driving portion which drives the punch unit at a trailing portion of the sheet;

a sheet-edge detecting sensor which performs detection of a sheet edge in a direction intersecting with a sheet conveyance direction;

a punch-unit moving device which moves the punch unit in the direction intersecting with the sheet conveyance direction;

a sheet detecting sensor which performs detection of a sheet position in the sheet conveyance direction; and a controller portion which controls the skew correction of the sheet and a punching operation on the sheet, wherein:

the punch unit is provided on an upstream side of the skew correcting portion in the sheet conveyance direction, the sheet detecting sensor is disposed in a position where a trailing edge of the sheet is detected after termination of the skew correction by the skew correcting portion, the controller portion controls such that after skew of the sheet is corrected by the skew correcting portion, positioning of the punch unit in the direction intersecting with the sheet conveyance direction is performed by the punch-unit moving device in accordance with a detection result of the sheet-edge detecting sensor, and punching is performed on the sheet by the punch driving portion in accordance with a detection result of the sheet detecting sensor, and when the sheet detecting sensor had detected the trailing edge of the sheet before termination of the skew correction by the skew correcting portion, the controller portion inhibits a punching operation by the punch unit.

14. The image forming apparatus according to claim 13, further comprising a skew amount detecting portion which detects a skew amount of the sheet being conveyed, wherein:

the skew correcting portion comprises two roller pairs which convey the sheet, wherein the individual roller pairs are disposed in the direction intersecting with the sheet conveyance direction; and in accordance with a detection result of the skew amount detecting portion, the controller portion causes conveyance speeds of the individual roller pairs to be different from each other, thereby to perform correction of the skew of the sheet having been conveyed.

15. The image forming apparatus according to claim 14, wherein:

the skew correcting portion comprises two drive sources which drive the individual roller pairs independently of each other; and in accordance with the detection result of the skew amount detecting portion, the controller portion controls driving speeds of the individual drive sources, thereby to cause the conveyance speeds of the individual roller pairs to be different from each other.

16. The image forming apparatus according to claim 13, wherein:

the sheet-edge detecting sensor moves along the direction intersecting with the sheet conveyance direction, thereby to perform the detection of the sheet edge; and the controller portion controls such that movement of the punch unit and the sheet-edge detecting sensor is started by the punch-unit moving device in accordance with the detection result of the sheet detecting sensor after termination of the skew correction by the skew correcting portion.

17. The image forming apparatus according to claim 13, further comprising a skew amount detecting portion which detects a skew amount of the sheet being conveyed, wherein:

the sheet-edge detecting sensor moves along the direction intersecting with the sheet conveyance direction, thereby to perform the detection of the sheet edge; and the controller portion performs a calculation of a correcting time necessary for the skew correction of the sheet by the skew correcting portion in accordance with the detection result of the skew amount detecting portion, and controls such that movement of the punch unit and the sheet-edge detecting sensor is started by the punch-unit moving device after passage of the correcting time.

* * * * *